US008646512B2

(12) United States Patent
Layton

(10) Patent No.: US 8,646,512 B2
(45) Date of Patent: Feb. 11, 2014

(54) DIE BRACE AND METHOD OF USE THEREOF

(75) Inventor: Chuck Lamar Layton, Pell City, AL (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/466,825

(22) Filed: May 8, 2012

(65) Prior Publication Data

US 2013/0299117 A1 Nov. 14, 2013

(51) Int. Cl.
*B22D 33/04* (2006.01)

(52) U.S. Cl.
USPC ..... 164/340; 164/341; 164/342

(58) Field of Classification Search
USPC ..... 164/339, 340, 341, 342
See application file for complete search history.

(56) References Cited

U.S. PATENT DOCUMENTS

| | | | | |
|---|---|---|---|---|
| 3,728,057 | A * | 4/1973 | Grundmann et al. | 425/136 |
| 5,066,217 | A * | 11/1991 | Fukuzawa et al. | 425/589 |
| 5,542,465 | A * | 8/1996 | Wolniak | 164/341 |
| 5,593,711 | A | 1/1997 | Glaesener | |
| 5,776,402 | A | 7/1998 | Glaesener | |
| 6,027,329 | A | 2/2000 | Nazarian et al. | |
| 6,171,097 | B1 | 1/2001 | Urbanek | |
| 7,168,946 | B2 * | 1/2007 | Koike et al. | 425/595 |
| 7,287,972 | B2 * | 10/2007 | Tsuji et al. | 425/149 |
| 7,318,721 | B2 | 1/2008 | Spicer et al. | |
| 7,491,051 | B2 | 2/2009 | Matsushita et al. | |
| 7,637,734 | B2 | 12/2009 | Nishimura et al. | |
| 7,784,525 | B1 * | 8/2010 | Dai | 164/120 |
| 7,857,612 | B2 | 12/2010 | Teng et al. | |
| 2006/0228438 | A1 * | 10/2006 | Koike et al. | 425/472 |
| 2009/0026645 | A1 * | 1/2009 | Tsuda et al. | 264/40.1 |
| 2010/0276105 | A1 * | 11/2010 | Yashiro et al. | 164/131 |

FOREIGN PATENT DOCUMENTS

| | | | | |
|---|---|---|---|---|
| JP | 2010-42551 A | | 2/2010 | |
| JP | 2010-042551 A | * | 2/2010 | B22D 17/26 |

* cited by examiner

*Primary Examiner* — Kevin P Kerns
(74) *Attorney, Agent, or Firm* — Standley Law Group LLP

(57) ABSTRACT

A die brace and method of use thereof for securing the relationship of one or more die tie bars and an associated back plate of a movable die core, such as a die core of a metal casting die. Embodiments of such a die brace generally include a collar that is adapted to fit over the die tie bar(s), a back plate bracket element that is adapted for affixation to a die core back plate, and a bracing leg that connects the collar to the bracket element.

19 Claims, 2 Drawing Sheets

DIE BRACE AND METHOD OF USE THEREOF

TECHNICAL FIELD

The present invention is directed to the field of molding and molding machines, such as die casting and die casting machines.

BACKGROUND

The forming of various objects by molding is well known. Objects may be formed from various plastics and metals, such as by injection or compression molding, casting, etc., using an appropriate mold. There is frequently a stationary and movable mold half, and more complex molds may include one or a plurality of stationary and/or movable cores. The mold is located in a molding machine, which is responsible for opening and closing the mold and, commonly, for supplying the molding material to the mold.

Metallic parts are frequently formed via a specialized metal molding process. One such process is metal die casting, where molten metal is introduced into a closed mold (die) and allowed to cool to a point where the die may be opened and the formed part may be removed. A casting die may include a stationary core and a plurality of movable cores that are brought together to form a closed die. These cores may be used to form certain part features such as openings, voids, etc. Frequently, some or all of such cores may be sand cores.

The die casting process also includes the use of a die casting machine. The die casting machine serves many functions, including supporting and opening/closing the casting die, providing the molten metal to the casting die, ejecting the cast part, etc.

With respect to such die casting processes, problem may result when there occurs a non-uniform opening of the casting die. For example, if a movable core does not separate evenly from and/or is not retracted evenly from the stationary core and/or other movable cores, damage may result. The types of resulting damage may include, without limitation, galling or other deformations or breakage of the cast metal part, and cracking or breaking of one or more of the aforementioned sand cores that are frequently used to create certain part features in the cast metal part.

An uneven opening of the casting die may have several causes. One such cause is an uneven application of opening force to one or more of the moving die cores. As can be seen in FIG. 1, many die casting machines transfer the moving die cores between an open and molding position by one or more hydraulic cylinders. In the particular example shown in FIG. 1, two hydraulic cylinders are used to transfer the right-most moving die core 20 between a retracted position (shown) and a casting position where the die core 20 is in contact with other die cores 15, 25, 30, 35 that collectively form the casting die 10. It should be readily apparent that in a die casting machine of such a design, an imbalance in the hydraulic force exerted by these cylinders can also result in a non-uniform opening and movement of the associated movable die core 20.

One skilled in the art would understand that die casting machines are typically provided with tie bars, bushings and/or other guiding means that help to maintain even, linear travel of a movable casting die core. It has been found, however, that such guiding means cannot always sufficiently prevent the uneven opening of a casting die—especially when such an uneven opening results from an imbalanced application of hydraulic die opening force as described above.

Consequently, it can be understood that there is a need for a device that can prevent the uneven opening of a casting die—or of a non-die casting mold having a similar structure. Preferably, such a device would be cost-effective to produce and easy to install to a die casting machine or other molding machine of interest. Die Brace embodiments of the invention satisfy this need.

SUMMARY

The invention is directed to embodiments of a brace that is installable between a die tie bar and the back plate of a movable and/or stationary die section (e.g., core). The brace is basically comprised of a collar or bushing that fits over a die tie bar, a bracket element that is adapted for affixation to the die core back plate, and a bracing leg that connects the collar to the bracket element. The bracing leg extends between the collar and bracket element at an angle. The angle may be approximately 45°.

With such a die brace installed, it has been found that the proper orientation between the die core back plate and the tie bar to which the brace is coupled is better maintained. More particularly, with a die brace of the invention installed, the tie bar is better maintained in a normal (perpendicular) orientation to the face of the die core back plate during opening and closing of the die. Consequently, at least a pair of die braces are preferably used, with each brace being installed to a separate tie bar and located on opposite sides of the back plate of a movable and/or stationary die core. In this manner, the back plate of the movable die core will maintain a proper 90° angle with the die tie bars during die opening, thereby helping to ensure that the casting die of which the movable core is a component will open evenly, and that movement of the movable die core will be even and linear.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
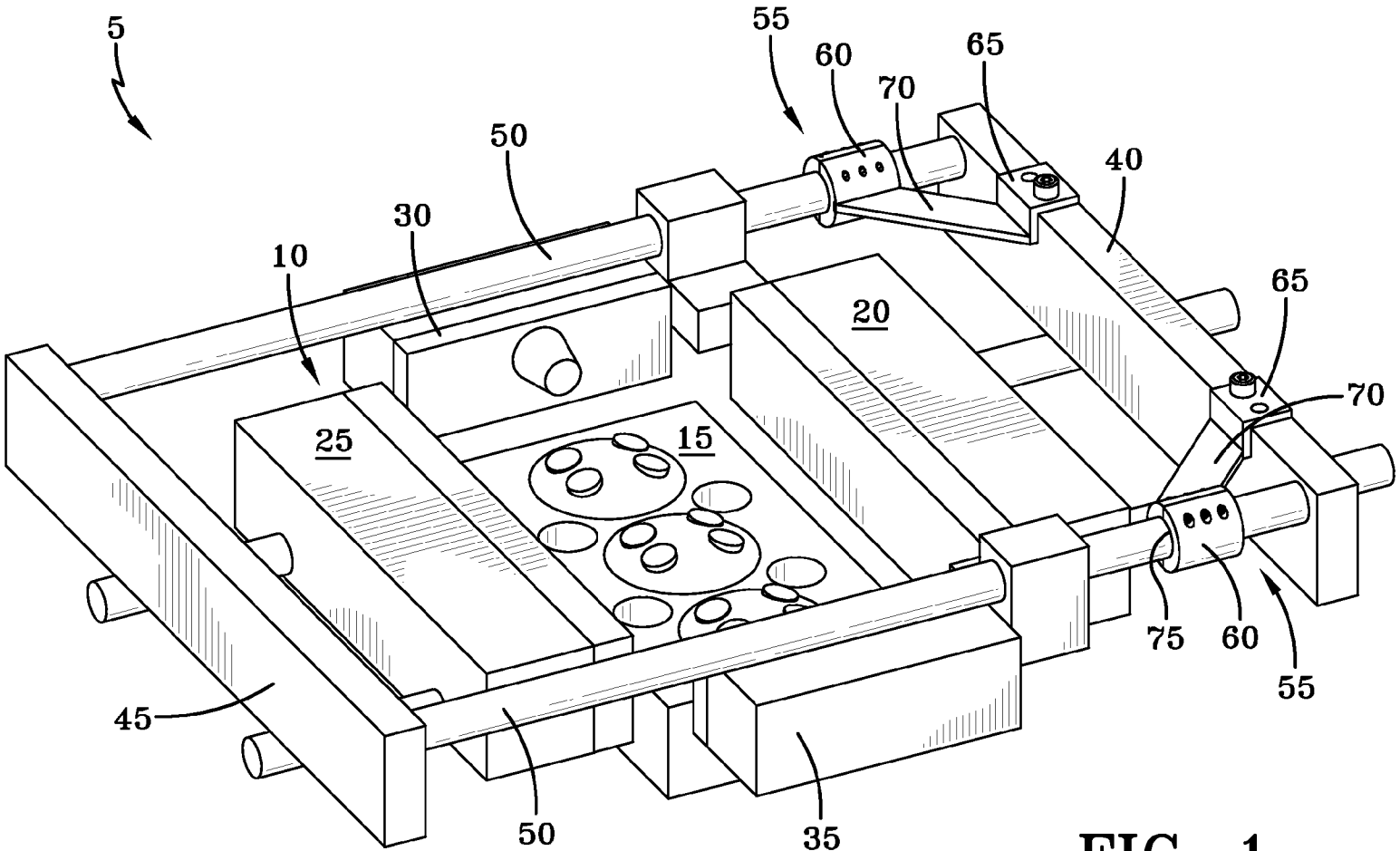
FIG. 1 depicts an exemplary pair of die braces of the invention installed between a set of die tie bars and the back plate of a movable die core.

For purposes of illustration of the invention, a portion of an exemplary die casting machine and associated metal casting die are depicted in FIG. 1. As shown, the die casting machine includes, among other things, a framework 5. An exemplary casting die assembly 10 is located in the die casting machine and includes a stationary die core 15, a first pair of opposed movable die cores 20, 25, and a second pair of opposed movable die cores 30, 35. Respective die back plates 40, 45 of the first pair of movable die cores 20, 25 are coupled to one another by a number of die tie bars 50. The movable die core back plates 40, 45 bound two sides of a work envelope in which an associated casting die 25 opens and closes, and within which cast parts are produced. An additional movable core that resides opposite the stationary core 15 is also present but not visible in this view.

Each of the stationary die core 15 and movable die cores 20-35 are equipped with sand cores for forming various features in parts made with the casting die. The exemplary casting die assembly 25 shown in FIG. 1 is used to make a vehicle engine component, but embodiments of the invention are equally applicable to die casting machines and other molding machines used to make other items.

As would be apparent to one of skill in the art, the exemplary casting die assembly 25 is depicted in an open position in FIG. 1. The casting die assembly 25 would, of course, be in a closed position during a casting operation, a position in which the movable die cores 20, 25, 30, 35 are—advanced toward the stationary die core 15. Upon die opening, the movable die cores 20, 25, 30, 35 are moved back to the position shown in FIG. 1.

Referring still to FIG. 1, and as would be understood by one of skill in the art, the die tie bars 50 properly extend normally (i.e., perpendicularly) into/from the movable die core back plates 40,45. In this manner, the back plates are held parallel to one another, with the mounting faces thereof perpendicular to the path of travel of the associated first pair of movable die cores 20, 25 and the tie bars 50 longitudinally oriented in the direction of travel of the associated first pair of movable die cores.

Thus, the tie bars 50 should form and maintain 90° angles with the die mounting faces of the movable die core back plates 40,45. However, it has been observed that at least during opening of the casting die, the orientation of the die tie bars 50 with respect to the movable die core back plate 10 may deviate/deflect from the desired 90° angles. This has been found to result in the galling and breakage problems described above.

Die brace embodiments of the invention have been developed as an effective countermeasure to the problem of movable die core back plate/die tie bar orientation deviation. One exemplary embodiment of a die brace 55 according to the invention may be observed in FIGS. 1-2. Generally speaking, the die brace 55 comprises a bushing or collar 60 that fits over a corresponding die tie bar 50, a back plate bracket element 65 that is adapted for affixation to a die core back plate (the movable die core back plate 40 in this case), and a bracing leg 70 that connects the collar to the bracket element.

In the exemplary embodiment shown, the collar 60 is substantially cylindrical in shape, although other cross-sectional shapes may also be employed. The collar 60 includes an axial thru-bore 75 of a diameter that corresponds substantially to the outer diameter of the tie bars 50. More particularly, the diameter of the thru-bore 75 preferably allows a corresponding tie bar 50 to pass therethrough. In this exemplary embodiment, the thru-bore 75 is also of a dimension that allows the collar to securely grip the tie bar 50. In other embodiments, for example where a core and back plate are designed to reciprocally travel over a set of fixed tie bars that pass through the back plate, collars of the invention may be designed to encircle the tie bars in a floating manner such that the associated die braces may travel with the back plate. In such a case, the thru-bores of the collars may be lined with Babbitt metal or may be fitted with some other type of linear bearing to facilitate movement over the tie bars.

This particular exemplary collar 60 is also of split design to facilitate installation of the die brace 55 on the tie bar 50. In the split design shown, the collar 60 is divided axially into two halves of substantially equal size. The two halves of the collar 60 are then appropriately drilled and tapped (threaded) to receive a number of correspondingly threaded fasteners 80 that are used to secure the collar halves to one another and to secure the collar in an encircling manner around the tie bar 50. One of the collar halves may be counter-bored or otherwise adapted for proper receipt of and contact with the threaded fasteners.

In other embodiments, the halves of a split collar may be held together by other than, or in conjunction, with threaded fasteners. For example, one or more clamps may be used. Alternatively, when comprised of an appropriate metal, the collar halves may be welded together after placement over the tie bar 50—although subsequent removal of the welded collar would require cutting. In still another alternative embodiment, a unitary (i.e., non-split) collar may be used if it is sufficiently practical to withdraw the corresponding tie bar from the movable die core back plate. Other collar embodiments are also possible, and such embodiments are not to be considered limited by the provided examples.

The die brace 55 is also shown to include a back plate bracket element 65 that is secured to the movable die core back plate 40. In this particular embodiment, the bracket element 65 is shown to be substantially L-shaped, such as may be manufactured from a section of steel angle. In this particular embodiment, the bracket element 65 is also shown to overlie the front and top faces of the movable die core back plate 40 when installed thereto, such that the edge formed by said faces is located against the inside corner of the bracket element.

In other embodiments, a bracket element may be of different shape and/or size. The shape and/or size of the bracket element may be based on, for example, the area of a movable die core back plate to which the bracket element will be affixed. For example, an alternative bracket element may be designed and located so as to overlie the front and right side faces of the movable die core back plate 10 when installed thereto, or may be designed and located to overlie only a single face (e.g., front face, top face, or side face) of the movable die core back plate when installed thereto. Other bracket element embodiments are also possible, and such embodiments are not limited by the examples described above.

As with the exact location of the bracket element 65, affixation of the bracket element to the movable die core back plate 40 may be accomplished in various ways. In the exemplary die brace embodiment shown, the bracket element 65 is affixed to the movable die core back plate 40 by a threaded fastener 85 that passes through the bracket element and is received by a correspondingly threaded hole placed in the back plate. The use of a threaded fastener is a convenient mechanism by which to secure the bracket element 65 to the movable die core back plate 40, because it allows for easy removal and reinstallation if necessary. Other affixation mechanisms may, however, also be employed, such as but not limited to welding (when appropriate bracket element and back plate materials are present).

The die brace 55 is also shown to include a bracing leg 70 that extends between and connects the collar 60 and the bracket element 65. The exact size and shape of the bracing leg 70 may vary, and may depend at least somewhat on the location of the bracket element 65 on the movable die core back plate 40. In the embodiment shown, the bracing leg 70 is comprised of a section of metal bar stock of some thickness, but the use of other structural and non-structural materials is also possible.

Figure 2:
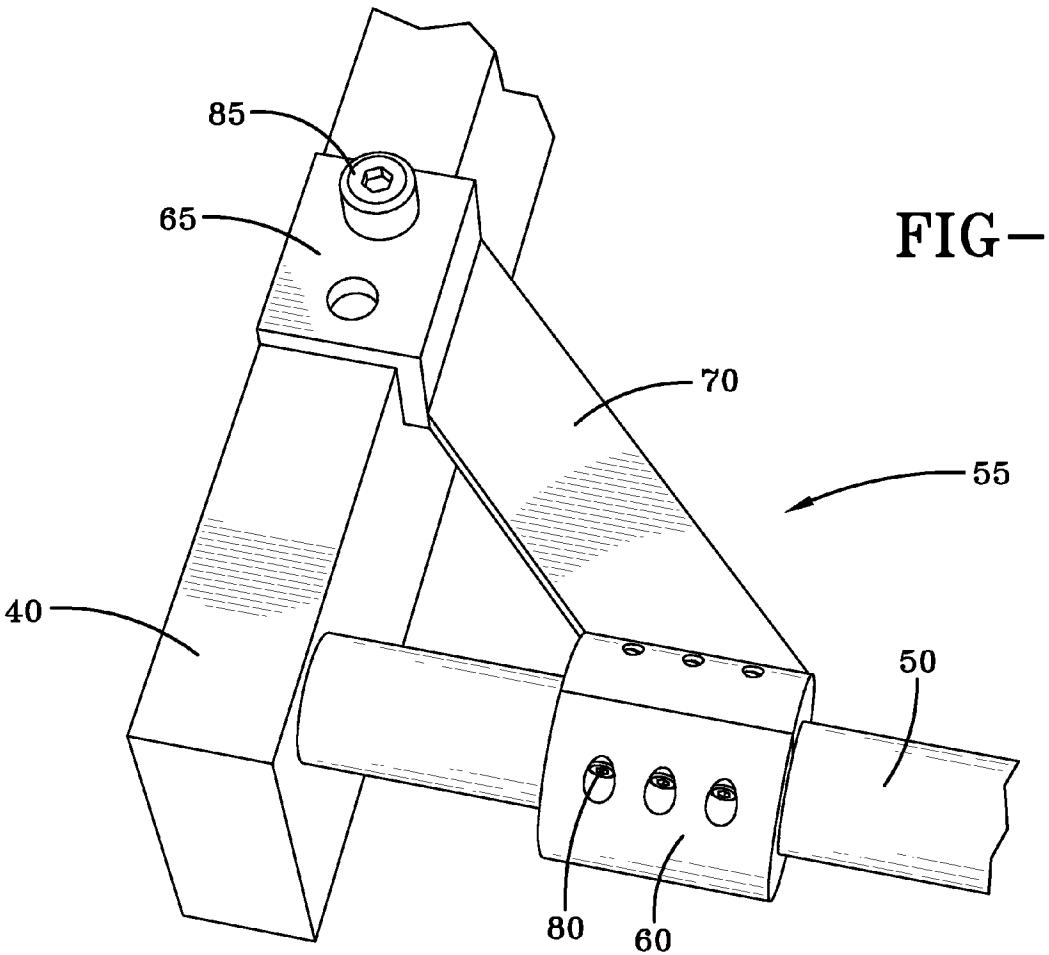
FIG. 2 is an enlarged view of an exemplary die brace of the invention.

As can be best observed in FIG. 2, the bracing leg 70 preferably extends between the collar 60 and the bracket element 65 at some angle $\alpha$ that will reinforce and help to maintain a proper orientation between the tie bar 50 and movable die core back plate 40 to which the die brace 55 is installed. In this particular exemplary embodiment, the bracing leg 70 extends between the collar 60 and bracket element 65 at an angle of approximately 45° (see FIG. 2) as measured from the front face of the back plate 40 or the longitudinal axis of the tie bar 50. The angled orientation of the bracing leg 70 helps to maintain the desired 90° angle between the die tie bar 50 and the movable die core back plate 40. A bracing leg may extend between the collar and bracket element of an alternative die brace embodiment at an angle of other than 45° as long as adequate reinforcement is still provided by the die brace.

It can be understood from the foregoing written description and accompanying drawing figures that the installation of a die brace, such as the exemplary die brace 55, between a die tie bar and a movable die core back plate, significantly helps to maintain the proper orientation and relationship of the tie bar and back plate. Likewise, a die brace, such as the exemplary die brace 55, may instead or also be installed between a die tie bar and a stationary die core back plate to maintain the proper orientation and relationship of the tie bar and movable die core back plate. Consequently, installing one or more such die braces to a die, such as a metal casting die, can minimize or eliminate the aforementioned problems attributable to uneven die opening.

While certain exemplary embodiments of the present invention are described in detail above, the scope of the invention is not to be considered limited by such disclosure, and modifications are possible without departing from the spirit of the invention as evidenced by the following claims:

What is claimed is:

1. A die brace comprising:

a collar adapted to fit over a die tie bar;

a back plate bracket element adapted for affixation to a back plate of a die casting mold die core, the die core being associated with the die tie bar; and a fixed position, integral bracing leg that extends at an angle between and connects the collar to the back plate bracket element;

wherein the angle of the bracing leg with respect to the collar and the back plate bracket element remains constant, such that the die brace is operative to maintain a proper orientation and relationship between the tie bar and back plate during opening of the casting mold.

2. The die brace of claim 1, wherein the back plate is the back plate of a movable die core.

3. The die brace of claim 1, wherein the collar is substantially cylindrical in shape and includes an axial thru-bore for passage of a die tie bar.

4. The die brace of claim 3, wherein the collar is adapted to securely grip a tie bar to which it is installed.

5. The die brace of claim 3, wherein the collar is adapted to float on a tie bar to which it is installed.

6. The die brace of claim 3, wherein the collar is of split design.

7. The die brace of claim 6, wherein the collar is divided substantially along the longitudinal centerline thereof into two halves.

8. The die brace of claim 7, wherein the collar halves are adapted to encircle a die tie bar and to be secured to one another with threaded fasteners.

9. The die brace of claim 1, wherein the back plate bracket element is substantially L-shaped and adapted to overlie a portion of a front and top face of a movable die core back plate.

10. The die brace of claim 1, wherein the bracing leg extends between the collar and the back plate bracket element at an angle of less than 90° as measured from either a front face of a movable die core back plate or a longitudinal axis of a die tie bar when the die brace is installed thereto.

11. The die brace of claim 10, wherein the angle is approximately 45°.

12. The die brace of claim 1, wherein the die tie bar and movable die core back plate are components of a metal casting die.

13. A die brace for installation between a movable die core back plate and an associated die tie bar of a metal casting die, the brace comprising:

a collar adapted to fit over and grip the die tie bar;

a back plate bracket element adapted for affixation to the movable die core back plate; and an integral bracing leg that extends between the collar and the back plate bracket element at a fixed angle of less than 90 degrees as measured from either a front face of the movable die core back plate or a longitudinal axis of the die tie bar when the die brace is installed thereto;

wherein the angle of the bracing leg with respect to the collar and the back plate bracket element remains fixed, such that the die brace is operative to maintain a proper orientation and relationship between the tie bar and back plate during movement of a movable die core associated with the movable die core back plate.

14. The die brace of claim 13, wherein the collar is substantially cylindrical in shape and includes an axial thru-bore for passage of the tie bar.

15. The die brace of claim 14, wherein the collar is of split design.

16. The die brace of claim 15, wherein the collar is divided substantially along the longitudinal centerline thereof into two halves.

17. The die brace of claim 15, wherein the collar halves are arranged to encircle the tie bar and adapted to be secured to one another with threaded fasteners.

18. The die brace of claim 13, wherein the back plate bracket element is substantially L-shaped and adapted to overlie a portion of the front and top faces of the movable die core back plate.

19. The die brace of claim 13, wherein the bracing leg extends between the collar and the back plate bracket element at an angle of approximately 45° .

* * * * *